US010188575B2

(12) United States Patent
Norstrem

(10) Patent No.: US 10,188,575 B2
(45) Date of Patent: Jan. 29, 2019

(54) CERVICAL ORTHOTIC DEVICE

(71) Applicant: Core Products International Inc., Osceola, WI (US)

(72) Inventor: Paul R. Norstrem, Dresser, WI (US)

(73) Assignee: Core Products International, Inc., Osceola, WI (US)

( * ) Notice: Subject to any disclaimer, the term of this patent is extended or adjusted under 35 U.S.C. 154(b) by 394 days.

(21) Appl. No.: 14/488,876

(22) Filed: Sep. 17, 2014

(65) Prior Publication Data

US 2015/0080949 A1 Mar. 19, 2015

Related U.S. Application Data

(60) Provisional application No. 61/878,859, filed on Sep. 17, 2013, provisional application No. 62/038,983, filed on Aug. 19, 2014.

(51) Int. Cl.
*A61H 1/00* (2006.01)
*A61H 1/02* (2006.01)

(52) U.S. Cl.
CPC ..... *A61H 1/008* (2013.01); *A61H 1/0296* (2013.01); *A61H 2201/0134* (2013.01); *A61H 2201/0157* (2013.01); *A61H 2201/1284* (2013.01); *A61H 2201/1609* (2013.01); *A61H 2203/0456* (2013.01)

(58) Field of Classification Search
CPC .. A61H 1/008; A61F 5/56; A47G 9/10; A47G 9/1009; A47G 9/1027; A47G 9/1036; A47G 9/1045; A47G 9/1054; A47G 9/1063; A47G 9/1072; A47G 9/1081; A47G 9/109; A47G 2009/1018
See application file for complete search history.

(56) References Cited

U.S. PATENT DOCUMENTS 3,648,308 A * 3/1972 Greenawalt ..... A47G 9/1072 297/391
5,423,099 A * 6/1995 Gulli ..... A47G 9/10 5/638
5,611,765 A * 3/1997 Koch, Jr. ..... A63B 23/03575 482/140
6,292,964 B1 * 9/2001 Rose ..... A47G 9/10 5/630
6,345,401 B1 * 2/2002 Frydman ..... A47G 9/10 5/636
6,751,818 B2 * 6/2004 Troop ..... A61G 7/072 5/630

(Continued)

*Primary Examiner* — Valerie L Woodward
(74) *Attorney, Agent, or Firm* — Schwegman Lundberg & Woessner, P.A.

(57) ABSTRACT

A cervical orthotic device is generally provided. The device includes a base, sidewalls extending upwardly therefrom, and a cervical support surface opposite the base. The cervical support surface unites the sidewalls. The sidewalls include opposingly paired lateral sidewalls and opposingly paired longitudinal sidewalls. The cervical support surface includes a first planar portion adjacent a first longitudinal sidewall of the opposingly paired longitudinal sidewalls, a second planar portion adjacent a second longitudinal sidewall of the opposingly paired longitudinal sidewalls, and an arcuate portion intermediate the planar portions. The arcuate portion of the cervical support surface delimits a cervical engagement ridge.

20 Claims, 2 Drawing Sheets

(56) References Cited

U.S. PATENT DOCUMENTS

| | | | | |
|---|---|---|---|---|
| 9,700,160 | B2 * | 7/2017 | Kim Thi Pham | A47G 9/10 |
| 2013/0305458 | A1 * | 11/2013 | Kim | A47G 9/10 5/645 |
| 2014/0359944 | A1 * | 12/2014 | Thompson | A61G 13/122 5/636 |

* cited by examiner

CERVICAL ORTHOTIC DEVICE

This is a United States national patent application filed pursuant to 35 USC § 111(a) claiming priority under 35 USC § 120 of/to U.S. Pat. Appl. Ser. No. 61/878,859 filed Sep. 17, 2013 and entitled NECK ORTHOTIC, and U.S. Pat. Appl. Ser. No. 62/038,983 filed Aug. 19, 2014 and entitled NECK ORTHOTIC, the disclosures of which are hereby incorporated by reference in their entireties.

TECHNICAL FIELD

The present invention generally relates to an orthotic device, more particularly, the subject disclosure is directed to a cervical orthotic device for counteracting forward head posture and to aid restoration of proper cervical posture.

BACKGROUND OF THE INVENTION

The terms "backbone" and "spine" each connote strength. If you're said to be spineless, you're being or acting cowardly, not standing up for yourself. As many of us know, a dysfunctional spin results in, among other things, diminished strength, i.e., weakness.

The human backbone, the vertebral column, provides a structure for skeletal support and consists of twenty-four articulating vertebrae and nine fused vertebrae, with individual vertebrae named according to region and position. The articulating vertebrae are, superior to inferior, the cervical (C1-C7), the thoracic (T1-T12), and the lumbar (L1-L5). The articulating vertebrae of the column are generally separated from each other by intervertebral discs which provide/impart a great deal of flexibility and resiliency for these column regions. The fused vertebrae, superior to inferior, included the sacral (S1-S5) and coccygeal (Co1-Co5).

The cervical vertebrae are the vertebrae immediately inferior to the skull. The first, topmost vertebrae (i.e., the atlas) along with the second vertebrae (i.e., the axis) delimit the joint connecting the skull and spine.

Via a cervical curve, convex forward and generally extending from the axis to the second thoracic vertebrae, the head is properly supported, with the cervical vertebrae allowing mobility of the head and cervical spine via flexion and extension of the cervical spinal structures. "Curves" are likewise associated with each of the thoracic (concave forward), lumbar (convex forward) and sacral (concave forward) regions of the vertebral column, with the thoracic and lumbar curves known as the kyphotic and lordotic curves respectively.

While especially configured for resiliency, misalignment or dysfunction of articulating vertebrae of the spinal column, i.e., subluxation, are a fact of life for a majority of the population at any given time. With regard to the cervical spine, trauma, chronic poor posture, arthritis and muscle tension/spasm are primary sources of neck subluxation. For example, prolonged, frequent sleep postures, such as prone or face down, are known to create too much rotation for too long (i.e., suboccipital subluxation), resulting in excessive torsion in the upper most portion of the cervical spine. Moreover, prolonged, frequent sitting is known to create too much flexion for too long (i.e., atlantoaxial subluxation), resulting in a lessened or reversed curve of the of the cervical spine and stress upon the atlas/axis joint. As to the former, a plethora of therapeutic pillows, intended to ergonomically support both the head and neck, are known. As to the latter, commercially available orthotic devices, as well as those part-and-parcel of a healthcare professional's tool box, are known and widely available to treat cervical spine subluxations, i.e., assist the restoration of proper cervical alignment/posture.

In the context of pillows, head and neck cradling is an aim in furtherance of restful, productive sleep. Commonly, such pillows have a contoured surface for receipt and support of both the head and neck, and sometimes the shoulders, characterized by one or more convex segments or portions (see e.g., U.S. Pat. No. 4,679,263 (Honer), U.S. Pat. No. 4,777,678 (Moore), U.S. Pat. No. 5,481,771 (Burk, IV), and U.S. Pat. No. 4,754,513 (Rinz)). A subset of such pillows are further characterized by one or more concave segments or portions (see e.g., U.S. Pat. No. 2,835,905 (Tomasson), U.S. Pat. No. 4,821,355 (Burkhardt), U.S. Pat. No. 4,916,765 (Castronovo, Jr.), U.S. Pat. No. 5,279,310 (Hsien), U.S. Pat. No. 5,797,154 (Contreras), U.S. Pat. No. 6,345,401 (Frydman), U.S. Pat. No. 6,381,784 (Davis et al.), U.S. Pat. No. 6,471,726 (Wang), and U.S. Pat. No. 7,013,512 (Hsu)). Notionally, the contoured surface of such therapeutic pillows are intended to mimic the natural curves of the head and neck, with the structure specifically performing a support function during sleep.

In the context of orthotic devices, more particularly, cervical orthotic devices, head and neck cradling is not an aim. As such devices are intended to restore cervical posture via manipulation, e.g., stretching, of the cervical spine or portions thereof, head support, e.g., cradling, structures are absent from such devices. Be that as it may, such cervical orthotic devices nonetheless are known to include a contoured neck engaging surface characterized by one or more convex segments or portions, and a concave segment merged therewith (see e.g., U.S. Pat. No. 8,713,732 (Dennewald)). With the convex segment or portion intended to act as a positional fulcrum and bendingly receive and engage a patient's neck, the merged convex segment or portion generally receives an inferior most portion of the neck and/or the shoulders of the patient. While select periodic use of such cervical orthotic devices generally assist restoration of proper cervical posture, it is believed that individuals seeking relief from cervical spine subluxations and the like would benefit from an improved cervical orthotic device characterized by a ridge line for active, focused cervical engagement. Moreover, it is believed advantageous and effective to include inferior and superior passive cervical support, adjacent the actively engaged portion, more particularly, passive supports characterized by "flats," i.e., planar segments or portions adjacent the ridge line. Further still, it is believed advantageous to provide a cervical orthotic device which is especially configured to decrease pressure on soft tissue of the cervical spine, and a device which is readily adaptable to treat a range patient cervical spine lengths.

SUMMARY OF THE INVENTION

A cervical orthotic device is generally provided. The device includes a base, sidewalls extending upwardly therefrom, and a cervical support surface opposite the base. The cervical support surface unites the sidewalls. The sidewalls include opposingly paired lateral sidewalls and opposingly paired longitudinal sidewalls. The cervical support surface includes a first planar portion adjacent a first longitudinal sidewall of the opposingly paired longitudinal sidewalls, a second planar portion adjacent a second longitudinal sidewall of the opposingly paired longitudinal sidewalls, and an arcuate portion intermediate the planar portions. The arcuate portion of the cervical support surface delimits a cervical engagement ridge.

Advantageously, the cervical engagement ridge of the cervical support surface is proximal a sidewall of the opposingly paired longitudinal sidewalls. Moreover, and not exclusively, the cervical engagement ridge is delimited by an arc having a length of about 2 inches.

Advantageously, a first longitudinal sidewall of the opposingly paired longitudinal sidewalls extends from the device base a greater distance than a second longitudinal sidewall of the opposingly paired longitudinal sidewalls extends from the device base. Moreover, and not exclusively, a height of the first longitudinal sidewall of the opposingly paired longitudinal sidewalls is about 1.5 times a height of the second longitudinal sidewall of the opposingly paired longitudinal sidewalls.

Advantageously, an area of the first planar portion of the cervical support surface exceeds an area of the second planar portion of the cervical support surface. Moreover, and not exclusively, the area of the first planar portion of the cervical support surface exceeds an area of the second planar portion of the cervical support surface by a factor of about 1.8.

Advantageously, the first planar portion of the cervical support surface extends from the first longitudinal sidewall of the opposingly paired longitudinal sidewalls at an angle less than the second planar portion of the cervical support surface extends from the second longitudinal sidewall of the opposingly paired longitudinal sidewalls. More particularly, but not exclusively, the first planar portion of the cervical support surface preferably extends from the first longitudinal sidewall of the opposingly paired longitudinal sidewalls at an angle of about 50 degrees, with the second planar portion of the cervical support surface extending from the second longitudinal sidewall of the opposingly paired longitudinal sidewalls at an angle of about 55 degrees.

Advantageously, the cervical orthotic device further includes an adaptation permitting select removal of a lowermost device portion. For example, the cervical orthotic device includes one or more slits spaced apart from and parallel with the device base to facilitate selective removal of a lowermost device thickness. The slit may traverse the opposingly paired longitudinal sidewalls and partially extend between the opposingly paired lateral sidewalls. Contrariwise, the slit may traverse the opposingly paired lateral sidewalls and partially extend between the opposingly paired longitudinal sidewalls.

BRIEF DESCRIPTION OF THE DRAWINGS

The device, apparatus, structure(s) and/or elements disclosed directly or implicitly herein may be embodied in other specific forms without departing from the spirit or general characteristics thereof, some of which forms have been indicated. Thus, the features described and depicted herein/herewith are to be considered in all respects illustrative and not restrictive with the following brief description of the drawings and their content provided.

DETAILED DESCRIPTION OF THE INVENTION

Figure 1:
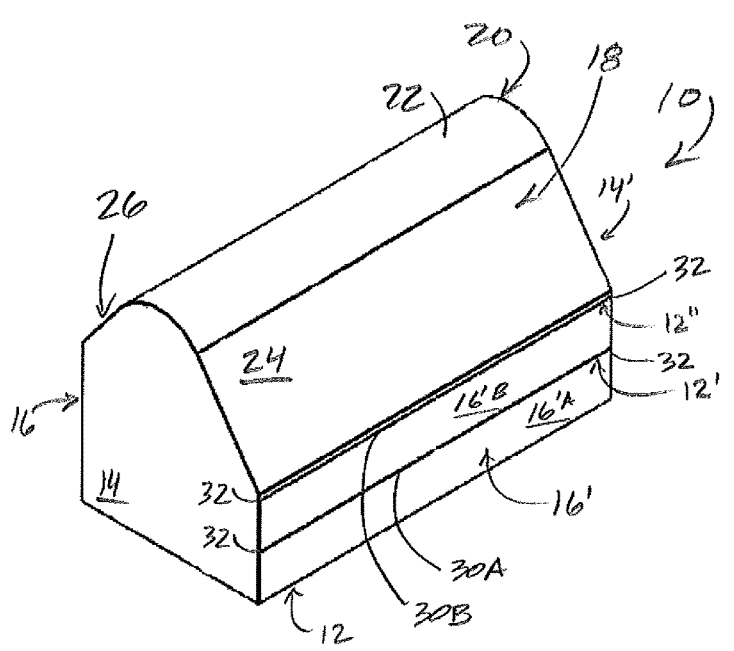
FIG. 1 is a front perspective view of an improved cervical orthotic device.
Figure 2:
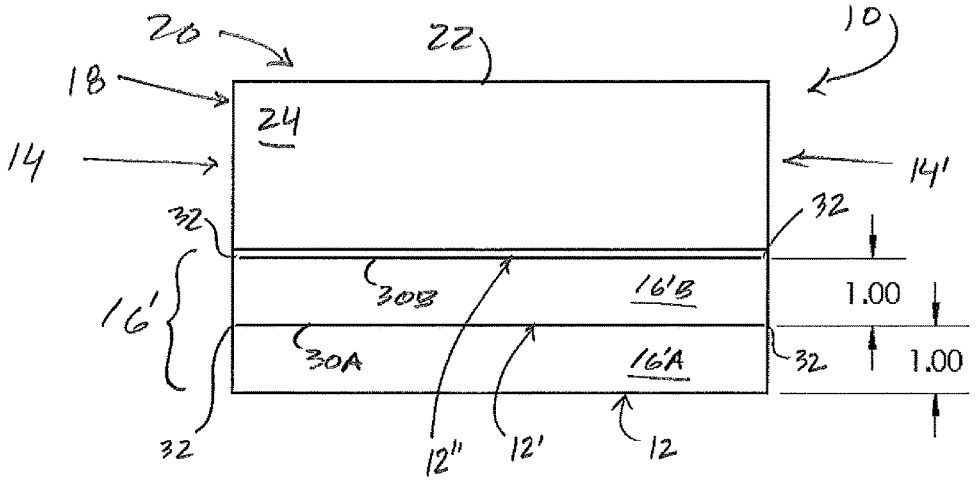
FIG. 2 is a front elevation view of the improved cervical orthotic device of FIG. 1.
Figure 3:
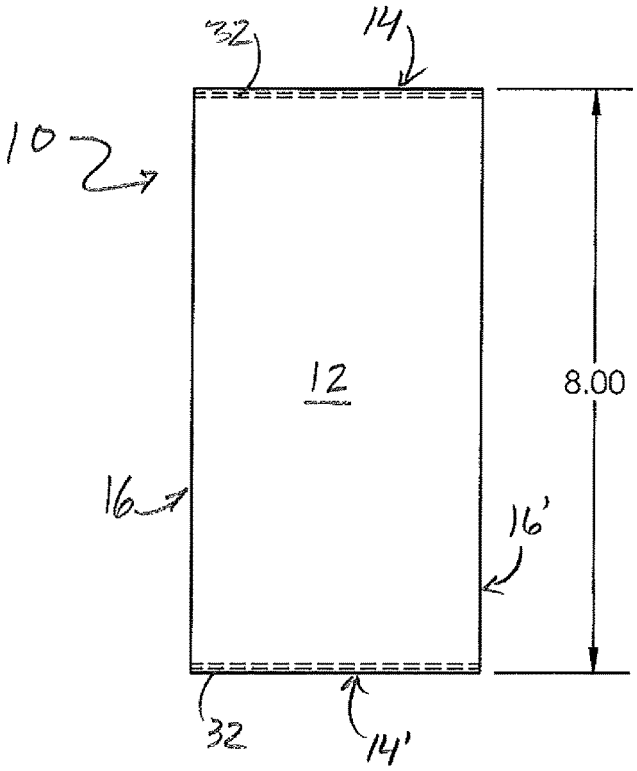
FIG. 3 is a plan view, from below, of the improved cervical orthotic device of FIG. 1; and, FIG. 4 is a side elevation view, proximal side, of the improved cervical orthotic device of FIG. 1

An improved cervical orthotic device is generally provided. A non-limiting embodiment of a contemplated device is generally shown in FIG. 1 and the several views of FIGS. 2-4. The view of FIG. 1 illustrates a superior to inferior device orientation, i.e., contemplated cervical vertebrae orientation, C1-C7, is figure left to right, see also FIG. 4.

Figure 4:
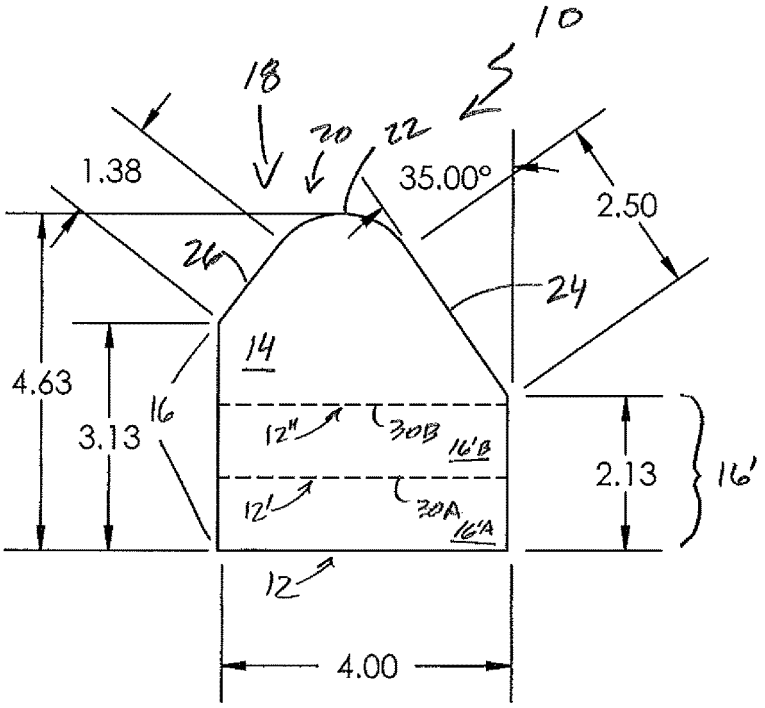

Characteristic of the illustrative embodiment is a cervical support surface having an arcuate portion intermediate first and second planar portions (FIGS. 1 & 4). The arcuate portion delimits a cervical engagement ridge for focused active engagement with a portion of the cervical spine, the planar portions adjacent the cervical engagement ridge for passive support of superior and inferior spinal portions.

With general reference to the illustrated embodiment of the figures, cervical orthotic device 10 generally comprises a base 12, opposingly paired end walls (i.e., lateral sidewalls) 14, 14' opposingly paired sidewalls (i.e., longitudinal sidewalls) 16, 16' and a cervical support surface 18. Cervical support surface 18 is advantageously characterized by a cervical engagement ridge 20 intermediate first and second "flats," more particularly, a first planar cervical support portion 24 adjacent first longitudinal sidewall 16, and a second planar cervical support portion 26 adjacent second longitudinal sidewall 16'. Cervical engagement ridge 20 is delimited by and/or corresponds to an uppermost extremity, i.e., an apex 22, of the opposingly paired lateral sidewalls.

Advantageously, but not necessarily, the subject cervical orthotic device includes an adaptation permitting select removal of a lowermost device portion. For example, the device 10 (FIG. 1 or FIG. 2) preferably, but not necessarily, includes one or more slits 30 or the like (e.g., 30A, 30B) which, as illustrated, traverse longitudinal sidewalls 16, 16' (i.e., in the context of "use," back (16) to front (16'), FIG. 4) throughout a substantial portion of their width. The slits notionally extend outwardly from a longitudinal sidewall centerline toward each of lateral sidewalls 14, 14' (i.e., in the context of "use" and as illustrated left (14) to right (14')) such that opposing longitudinal sidewall segments 32 remain on either free end of the slit. Via slits 30A, 30B, sidewall portions 16A (16'A) and 16B (16'B) are delimited. Contrariwise, one or more slits may traverse lateral sidewalls 14, 14' throughout a substantial portion of their width such that opposing lateral sidewall segments (not shown) remain on either free end of the slit. In-as-much as two slits are indicated so as to delimit sidewall portions of substantially equivalent thicknesses, the number of slits and their height relative to base 14, or thickness per se, may be readily designated. Via the aforedescribed feature, a clinician or the like may selectively dimension the cervical orthotic device height via slicing or otherwise breaching opposing segments 32 associated with a select slit so as remove a lowermost device portion, e.g., A or B, and establish a renewed base 12' or 12" in relation to longitudinal sidewall sections or portions 16A and 16B respectively. Via such adaptation or the like, the device is readily altered to treat a range of patient cervical spine lengths as the pivot or fulcrum distance corresponding to the ridge line is essentially selectable.

With particular reference to FIG. 4, several particulars with regard to the configuration of the cervical support surface, and relationships between, for and among elements of the illustrated cervical orthotic device are to be hereinafter noted. Preliminarily, and generally, the contemplated device advantageously, but not necessarily, has its origins in an approximately 8"×4"×4.75" rectangular block of closed cell cross-linked polyethylene (XLPE) foam. The XLPE foam has been found to have superior resiliency, provide desired cushioning, and offer a smooth, soft aesthetic feel, all advantageous characteristics for orthopedic soft goods, for example, cervical orthotic devices. As previously noted, and appreciated with reference to FIGS. 2 & 4, lowermost portion or "slices" of the device may be selectively removed in furtherance of precision orthotic treatment via force(s) imparted to a select cervical spinal segment by the cervical engagement ridge of the arcuate portion of the cervical support surface, and adjacent support of superior and inferior spinal portions by first and second planar cervical support surface portions.

As best seen with reference to FIG. 4, longitudinal sidewalls 14, 14' are advantageously of unequal height in relation to base 12 (or, 12', or 12"), i.e., the dimension associated with their respective upward extension from the base. The greater dimensioned first longitudinal sidewall is a superior sidewall with the lesser dimensioned longitudinal sidewall an inferior sidewall. In a preferred embodiment, the superior sidewall has a dimension of about 3.13", with the inferior sidewall having a dimension of about 2.13." While such values are illustrative and non-limiting, it is believed advantageous to maintain a ratio of about 1.5 for the superior sidewall height in relation to the inferior sidewall height.

Apex 22, delimiting cervical engagement ridge 20 of cervical support surface 18, of the lateral sidewalls 14, 14' is advantageously not intermediate the opposed longitudinal sidewalls 16, 16', instead, apex 22 is closer to the taller, superior longitudinal sidewall, i.e., longitudinal sidewall 16 as shown. In a preferred embodiment, apex 22 is about 1.25" from the superior longitudinal sidewall, with it believed advantageous to position the sidewall ridge proximal to the superior longitudinal sidewall by a factor of about 0.3 in relation to the width of the lateral sidewall. Moreover, the apex of each of the opposingly paired lateral sidewalls preferably but not necessarily rises from the base by about 4.63", with that value being a maximum for the preferred embodiment.

The cervical engagement ridge generally notionally comprises a portion of cylinder spanning the lateral sidewalls. The ridge advantageously but not exclusively corresponds to an upper most "pie" segment of an approximately 2" diameter cylinder, more particularly, an upper most segment of about 100-105 degrees which yields an arc having a length of about 2". This device feature provides focused active engagement with a select cervical spinal segment.

With continued reference to FIG. 4, adjacent the cervical engagement ridge are the planar portions of the cervical support surface. The first planar portion, a superior planar portion, generally extends upwardly from the superior longitudinal sidewall. More particularly, and advantageously, the superior planar portion of the preferred embodiment extends at an angle of about 50 degrees in relation to the device base. The second planar portion, an inferior planar portion, generally extends upwardly from the inferior longitudinal sidewall. More particularly, and advantageously, the inferior planar portion of the preferred embodiment extends at an angle of about 55 degrees in relation to the device base. Via the stated preferred, non-limiting relationships, widths for each of the superior and inferior planar cervical support surface portions are about 1.38" and 2.5" respectively.

Operatively, the subject cervical orthotic device is generally positioned in the area of lorodotic loss, the patient having been supinely positioned upon a firm surface. More particularly, the cervical engagement ridge of the cervical support surface is directed to the focal area with the larger of the planar cervical support surface portions facing the shoulders of the patient. Via proper ridge line placement, a pivot of fulcrum is established with respect to the target treatment area, with the patient's head generally elevated relative to their firm surface support.

Generally, daily use is recommended, with increasing treatment time intervals advantageous. A initial treatment time of 2 minutes is recommended, with daily treatments increasing by 1 minute, with a maximum treatment time of 20 minutes. Treatment is advantageously followed by the application of ice, or other active cold therapy agent, for about 15 minutes. Via the aforedescribed device, particularly the described features and the relationships for between and among same, a variety of therapeutic benefits are achieved, for example and without limitation, restoration of proper cervical posture, counteraction of forward head posture, decrease pressure on cervical soft tissue, and recover assistance with regard to acceleration/deceleration cervical injuries.

Since the device, apparatus, structure(s) and/or elements disclosed directly or implicitly herein may be embodied in other specific forms without departing from the spirit or general characteristics thereof, some of which forms have been indicated, the embodiments described and depicted herein/with are to be considered in all respects illustrative and not restrictive. Accordingly, the scope of the subject invention is as defined in the language of the appended claims, and includes not insubstantial equivalents thereto.

What is claimed is:

1. A cervical orthotic device comprising:

a base having a length and a width;

sidewalls extending upwardly from the base, wherein the sidewalls include:

opposingly paired lateral sidewalls; and opposingly paired longitudinal sidewalls:

a cervical support surface opposite said base and uniting said sidewalls, the cervical support surface having a cervical engagement ridge extending parallel with, and in the same direction as, the width of the base, the cervical support surface also including:

a first planar portion adjacent a first longitudinal sidewall of the opposingly paired longitudinal sidewalls and extending therefrom;

a second planar portion adjacent a second longitudinal sidewall of the opposingly paired longitudinal sidewalls and extending therefrom; and an arcuate portion intermediate the first planar portion and the second planar portion and extending from a first lateral sidewall of the opposingly paired lateral sidewalls to the other lateral sidewall of the opposingly paired lateral sidewalls, the arcuate portion delimiting the cervical engagement ridge for the cervical support surface;

wherein an apex of the cervical engagement ridge defines a height of the cervical orthotic device from the base;

wherein a ratio of a maximum height of the cervical orthotic device to the length is greater than or equal to 1.1575; and wherein a height of the first longitudinal sidewall of the opposingly paired longitudinal sidewalls is about 1.5 times a height of the second longitudinal sidewall of the opposingly paired longitudinal sidewalls.

2. The cervical orthotic device of claim 1, wherein said cervical engagement ridge of said cervical support surface is proximal a sidewall of said opposingly paired longitudinal sidewalls.

3. The cervical orthotic device of claim 1, wherein said cervical engagement ridge is delimited by an arc having a length of about 2 inches.

4. The cervical orthotic device of claim 1, wherein an area of said first planar portion of said cervical support surface exceeds an area of said second planar portion of said cervical support surface.

5. The cervical orthotic device of claim 1, wherein an area of said first planar portion of said cervical support surface exceeds an area of said second planar portion of said cervical support surface by a factor of about 1.8.

6. The cervical orthotic device of claim 1, wherein said first planar portion of said cervical support surface extends from said first longitudinal sidewall of said opposingly paired longitudinal sidewalls at an angle less than said second planar portion of said cervical support surface extends from said second longitudinal sidewall of said opposingly paired longitudinal sidewalls.

7. The cervical orthotic device of claim 1, wherein said first planar portion of said cervical support surface extends from said first longitudinal sidewall of said opposingly paired longitudinal sidewalls at an angle of about 50 degrees.

8. The cervical orthotic device of claim 1, wherein said second planar portion of said cervical support surface extends from said second longitudinal sidewall of said opposingly paired longitudinal sidewalls at an angle of about 55 degrees.

9. The cervical orthotic device of claim 1 further comprising an adaptation permitting select removal of a lowermost device portion.

10. The cervical orthotic device of claim 1, further comprising a slit spaced apart from and parallel with said base to facilitate selective removal of a lowermost device thickness, said slit traversing said opposingly paired longitudinal sidewalk and partially extending between said opposingly paired lateral sidewalls.

11. The cervical orthotic device of claim 1, further comprising spaced apart slits, a first slit spaced apart from and parallel with said base, a second slit spaced apart from and parallel with said first slit, said slits facilitating selective removal of a lowermost device thickness, said slits traversing said opposingly paired longitudinal sidewalls and partially extending between said opposingly paired lateral sidewalls.

12. The cervical orthotic device of claim 1, further comprising a slit spaced apart from and parallel with said base to facilitate selective removal of a lowermost device thickness, said slit traversing said opposingly paired lateral sidewalls and partially extending between said opposingly paired longitudinal sidewalls.

13. The cervical orthotic device of claim 1, further comprising spaced apart slits, a first slit spaced apart from and parallel with said base, a second slit spaced apart from and parallel with said first slit, said slits facilitating selective removal of a lowermost device thickness, said slits traversing said opposingly paired lateral sidewalls and partially extending between said opposingly paired longitudinal sidewalls.

14. The cervical orthotic device of claim 1, wherein the first longitudinal sidewall extends from the base a greater distance than the second longitudinal sidewall extends from said base.

15. A cervical orthotic device comprising:

a base having a length and a width;

sidewalls extending upwardly from the base, wherein the sidewalls include:

opposingly paired lateral sidewalls; and opposingly paired longitudinal sidewalls;

a cervical support surface opposite said base and uniting said sidewalls, the cervical support surface having a cervical engagement ridge extending parallel with, and in the same direction as, the width of the base, the cervical support surface also including:

a first planar portion adjacent a first longitudinal sidewall of the opposingly paired longitudinal sidewalls and extending therefrom;

a second planar portion adjacent a second longitudinal sidewall of the opposingly paired longitudinal sidewalls and extending therefrom; and an arcuate portion intermediate the first planar portion and the second planar portion and extending from a first lateral sidewall of the opposingly paired lateral sidewalls to the other lateral sidewall of the opposingly paired lateral sidewalls, the arcuate portion delimiting the cervical engagement ridge for the cervical support surface;

wherein an apex of the cervical engagement ridge defines a height of the cervical orthotic device from the base;

wherein a ratio of a maximum height of the cervical orthotic device to the length is greater than or equal to 1.1575; and wherein an area of said first planar portion of said cervical support surface exceeds an area of said second planar portion of said cervical support surface.

16. The cervical orthotic device of claim 15, further comprising an adaptation permitting select removal of a lowermost device portion.

17. The cervical orthotic device of claim 15, wherein an area of said first planar portion of said cervical support surface exceeds an area of said second planar portion of said cervical support surface.

18. A cervical orthotic device comprising:

a base having a length and a width;

sidewalls extending upwardly from the base, wherein the sidewalls include:

opposingly paired lateral sidewalls; and opposingly paired longitudinal sidewalls;

a cervical support surface opposite said base and uniting said sidewalls, the cervical support surface having a cervical engagement ridge extending parallel with, and in the same direction as, the width of the base, the cervical support surface also including:

a first planar portion adjacent a first longitudinal sidewall of the opposingly paired longitudinal sidewalls and extending therefrom;

a second planar portion adjacent a second longitudinal sidewall of the opposingly paired longitudinal sidewalls and extending therefrom; and an arcuate portion intermediate the first planar portion and the second planar portion and extending from a first lateral sidewall of the opposingly paired lateral sidewalls to the other lateral sidewall of the opposingly paired lateral sidewalls, the arcuate portion delimiting the cervical engagement ridge for the cervical support surface;

wherein an apex of the cervical engagement ridge defines a height of the cervical orthotic device from the base;

wherein a ratio of a maximum height of the cervical orthotic device to the length is greater than or equal to 1.1575; and wherein said first planar portion of said cervical support surface extends from said first longitudinal sidewall of said opposingly paired longitudinal sidewalls at an angle less than said second planar portion of said cervical support surface extends from said second longitudinal sidewall of said opposingly paired longitudinal sidewalls.

19. The cervical orthotic device of claim 18, further comprising an adaptation permitting select removal of a lowermost device portion.

20. The cervical orthotic device of claim 18, wherein an area of said first planar portion of said cervical support surface exceeds an area of said second planar portion of said cervical support surface.

* * * * *